US012616281B2

(12) United States Patent
Maire et al.

(10) Patent No.: US 12,616,281 B2
(45) Date of Patent: May 5, 2026

(54) BRACELET FASTENING DEVICE

(71) Applicant: Montres Jaquet Droz SA, La Chaux-de-Fonds (CH)

(72) Inventors: François Maire, Bienne (CH); Philipp Tschumi, Niederwil (CH); Steeve Gerber, La Neuveville (CH); Philippe Scherrer, Delémont (CH); Alain Strautmann, Neuchâtel (CH)

(73) Assignee: MONTRES JAQUET DROZ SA, La Chaux-de-Fonds (CH)

( * ) Notice: Subject to any disclaimer, the term of this patent is extended or adjusted under 35 U.S.C. 154(b) by 295 days.

(21) Appl. No.: 18/451,548

(22) Filed: Aug. 17, 2023

(65) Prior Publication Data

US 2024/0197044 A1 Jun. 20, 2024

(30) Foreign Application Priority Data

Dec. 19, 2022 (EP) ..... 22214599

(51) Int. Cl.
*A44C 5/14* (2006.01)

(52) U.S. Cl.
CPC ..... *A44C 5/147* (2013.01)

(58) Field of Classification Search
CPC .. A44C 5/147; A44C 5/14; A44C 5/02; A44C 5/142; G04B 37/1493; G04B 37/1486; G04B 37/0008
See application file for complete search history.

(56) References Cited

U.S. PATENT DOCUMENTS

| | | | | |
|---|---|---|---|---|
| 10,993,512 | B2 * | 5/2021 | Rochat | G04B 37/1493 |
| 11,089,847 | B2 * | 8/2021 | Golay | G04B 37/1486 |
| 11,464,301 | B2 * | 10/2022 | Pesenti | G04B 37/1493 |
| 2020/0292995 | A1 * | 9/2020 | Garcin | G04B 19/18 |

FOREIGN PATENT DOCUMENTS

| | | |
|---|---|---|
| EP | 3709103 A1 | 9/2020 |
| FR | 3103913 A1 | 6/2021 |

OTHER PUBLICATIONS

European Search Report of No. 22214599 dated May 24, 2023.

* cited by examiner

*Primary Examiner* — Edwin A. Leon
(74) *Attorney, Agent, or Firm* — Sughrue Mion, PLLC

(57) ABSTRACT

A device (1) for fastening a bracelet (2) to a watch case (3), at two pairs of horns (4), by a female connecting element (5) secured to the case (3) of the watch and a male element (6) secured to one end (20, 21) of the bracelet, these elements being complementary cooperate by fitting one into the other, while forming removable assembly capable of making the bracelet interchangeable. The male element includes a rod (7) connected to an end (20, 21) of the bracelet, and extending on either side of the rod, a ball-pawl (8) and first (70) and second (80) cylindrical shouldered portions arranged concentrically around each ball-pawl, each ball-pawl and each cylindrical shouldered portion being arranged to cooperate respectively with blind housing (50) and groove (51) proximate to the blind housing, and forming the female connecting elements on inner areas of the two pairs of horns.

12 Claims, 4 Drawing Sheets

BRACELET FASTENING DEVICE

CROSS REFERENCE TO RELATED APPLICATIONS

This application is claiming priority based on European Patent Application No. 22214599.7 filed on Dec. 19, 2022.

TECHNICAL FIELD OF THE INVENTION

The present invention relates to the field of watchmaking or jewellery. More specifically, it relates to a device for fastening a bracelet to an object, in particular a watch case.

TECHNOLOGICAL BACKGROUND

In general, leather or metal bracelets are fastened to the horns of a watch case by means of a bar formed by a tube, in which two pistons are mounted movable in translation, and an elastic member arranged between said pistons and tending to push them outwards from the tube. Said bar is mounted in a housing provided to this end at one end of the bracelet, and the pistons are fitted in opposing blind bores in the horns of the case.

To detach a bracelet fastened to a case in this way, a tool designed to push the pistons back into the tube, against the stress exerted by the elastic member, is required, thereby extracting them from the bores. Such a tool is not permanently available to the wearer of the watch, and in addition, its use might turn out to be inconvenient. This is why bracelets fitted with such a fastening device are generally permanently attached to the case.

Moreover, there are fastening devices allowing detaching the bracelet from the case without the use of tools. Such devices usually include a bar of the type described before, on which a piston actuation member is mounted through the tube. For example, said actuation member is a radial finger secured to one of the pistons, as described in the patent CH 327 838. The finger is slidably mounted through an axial slot formed in the tube, and its movement along the slot allows pushing one of the pistons into the tube.

The patent CH 614 589 describes a watch case with a device for fastening a bracelet to the case. The central horn has a cylindrical passage slit longitudinally over the entire length of the horn, enabling the insertion of a bar for fastening a bracelet. The bar is in the form of a cylinder with a flat surface over its entire length so as to let the bar pass through when it is inserted into the passage and to hold it in place when it occupies a determined angular position.

The fastening devices thus described are generally used for interchangeable bracelets, allowing them to be replaced at the wearer's discretion. Nonetheless, they are not with no drawbacks. In particular, it should be noted that they require major structural modifications at the bar, such as the creation of an opening at the tube, or the transformation of the pistons. These changes lead to significant additional manufacturing costs. Moreover, these fastening devices have a protruding element, namely the actuation member, which can snag or injure the wearer of the watch.

SUMMARY OF THE INVENTION

In particular, an objective of the invention is to overcome the different drawbacks of bracelet fastening devices of the prior art.

To this end, the invention relates to a device for fastening a bracelet to a watch case, at two pairs of horns, by means of at least one female connecting element secured to the case of the watch and at least one male element secured to one end of the bracelet, these elements being complementary so as to cooperate by fitting one into the other, while forming removable assembly means capable of making the bracelet interchangeable.

According to the invention, each of the male elements consists of a rod connected to a corresponding end of the bracelet, and extending on either side of the axis, a ball-pawl and first and second cylindrical shouldered portions arranged concentrically around each ball-pawl, each ball-pawl and each cylindrical shouldered portion being arranged to cooperate respectively with a blind housing and a groove proximate to the blind housing, and forming the female connecting elements on inner areas of the two pairs of horns.

In accordance with other advantageous variants of the invention:

- each female connecting element comprises a ramp arranged upstream of the blind housing, the ramp being arranged to cooperate with the ball-pawl, the blind housing being at the end of the ramp;
- the groove successively comprises a rectilinear portion and an arcuate portion;
- the groove comprises a first stop element to limit the rotation of the rod;
- the first shouldered portion has a height larger than the radius of the rod, and the second shouldered portion has a height smaller than the radius of the rod;
- the first shouldered portion has a local notch at its periphery, the notch defining the length of the angular travel of the rod and being arranged to cooperate with a second stop element;
- the second stop element is superimposed on the first stop element and offset with respect to the first stop element;
- each female connecting element is an element attached on the inner areas of the two pairs of horns;
- each female connecting element is made of a metal material or of a metal alloy;
- the end of the bracelet comprises a passage arranged to receive the rod;
- the bracelet is secured to the rod.

The invention also relates to a watch equipped with a fastening device in accordance with the invention.

BRIEF DESCRIPTION OF THE FIGURES

Other features and advantages of the invention will appear upon reading the following detailed description given as a non-limiting example, with reference to the appended drawings wherein.

DETAILED DESCRIPTION OF THE INVENTION

Figure 1:
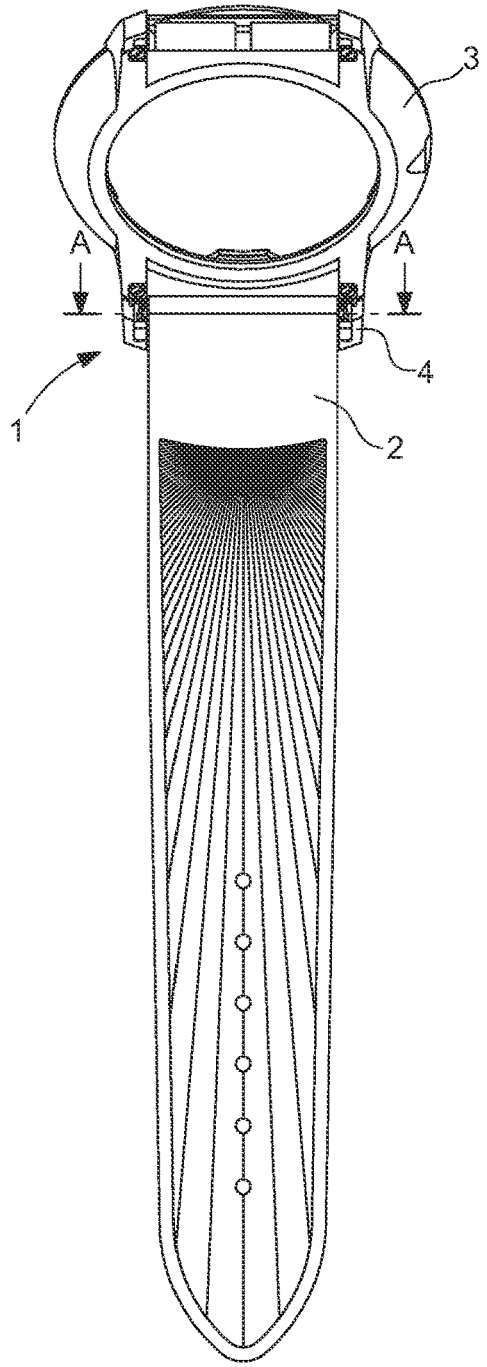
FIG. 1 shows an exploded perspective view of a bracelet attached to a watch case by means of a fastening device according to the invention.
Figure 2:
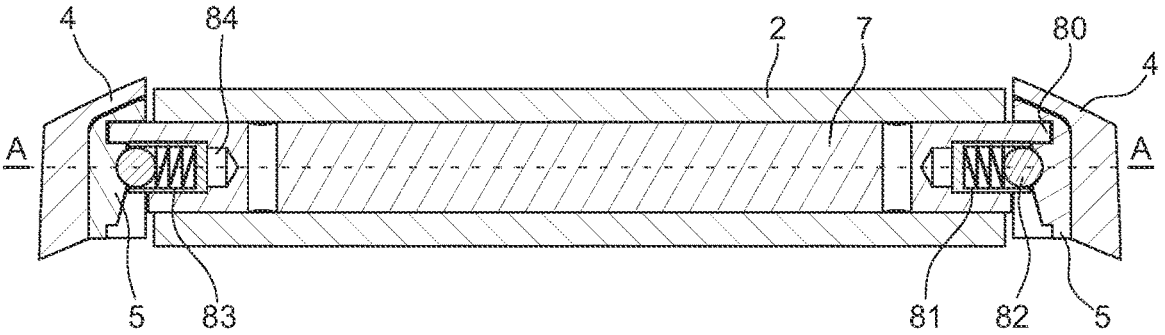
FIG. 2 shows a sectional view according to the axis A-A of FIG. 1.

FIG. 1 illustrates a watch case equipped with a device for fastening a bracelet to a watch according to the invention.

The fastening device 1 is intended to secure the ends 20, 21 of a bracelet 2 to a watch case 3, at its horns 4.

The bracelet is fastened to the case by means of a fastening device 1 comprising a female connecting element 5, secured to the horn 4 of the watch, and a male element 6 secured to the end 20, 21 of the bracelet 2, the female element 5 and the male element 6 being complementary and cooperating by fitting one into the other, to form removable assembly capable of making the bracelet interchangeable.

According to the invention, each of the male elements consists of a cylindrical rod 7, with a longitudinal axis AA, arranged at a corresponding end 20, 21 of the bracelet 2. This rod 7 is extended on either side by a ball-pawl 8 housed in a cylindrical cavity 84 centered on the axis AA.

Typically, the ball-pawl 8 consists of a body 81 in which a spring 83 and a ball 82 are housed, the body 81 resting in the cylindrical cavity 84.

Each of the male elements also comprises first 70 and second 80 cylindrical shouldered portions arranged concentrically around each ball-pawl 8, the first cylindrical shouldered portion 70 partly encircling the ball 82 of the ball-pawl 8.

At each of its ends (20, 21), the bracelet comprises a passage arranged to receive the rod 7 and hold it in place. The rod 7 is secured to the bracelet and is rendered rotationally immobile relative to the bracelet by means of pins securing the rod to the bracelet.

Each cylindrical shoulder is formed by the intersection of two mutually orthogonal planes, one of the planes being perpendicular to the longitudinal axis AA of the rod 7, and the other plane being parallel to this same longitudinal axis AA.

According to the invention, each female portion 5 comprises a blind housing 50 arranged to cooperate with the ball-pawl 8, and a groove 51 arranged to cooperate with the second cylindrical shouldered portion 80, the blind housing and the groove forming the female connecting elements on inner areas of the two pairs of horns 4.

Figure 5:
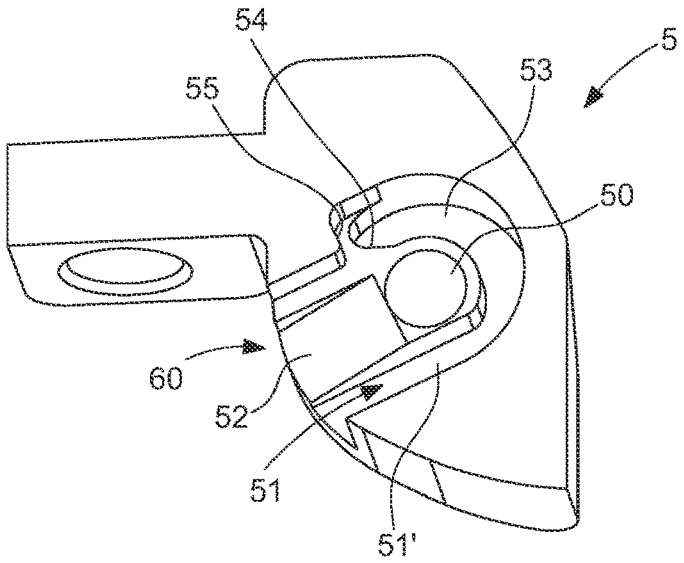
FIG. 5 shows a perspective view of a female portion of a fastening device according to the invention.

As shown in FIG. 5, each female connecting element 5 comprises a ramp 52, arranged upstream of the blind housing 50, to cooperate with the ball-pawl 8 and guide the latter to the blind hole 50 located at the end of the ramp 52. In this arrangement, the blind hole 50 is raised above the back of the groove 51.

Advantageously, groove 51 successively comprises a first rectilinear portion 51' and a second arcuate portion 53 in order to be able to insert the second cylindrical shouldered portion 80 in translation into the first rectilinear portion 51' until the ball-pawl fits in the blind hole 50, then making the rod 7 pivot until placing it in the wearing position.

Thus, the first rectilinear portion 51' of groove 51 runs along the ramp 52 and the second circular-arc portion 53 circumvents the blind hole, forming a continuous groove 51 guiding the rod 7 in translation and then in rotation.

Figure 4A:
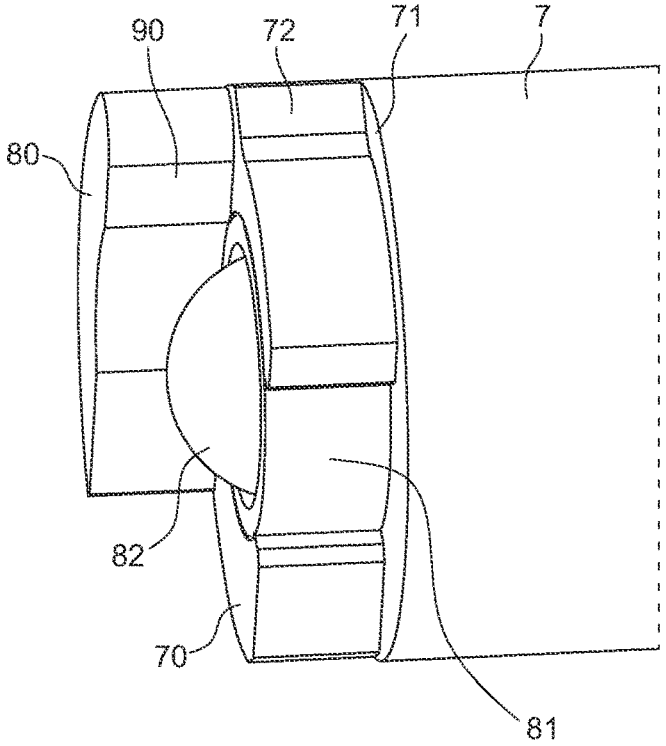
FIGS. 4*a*, 4*b* and 4*c* illustrate, respectively, a perspective view, a sectional view and a front view of a male portion of a fastening device according to the invention.
Figure 4B:
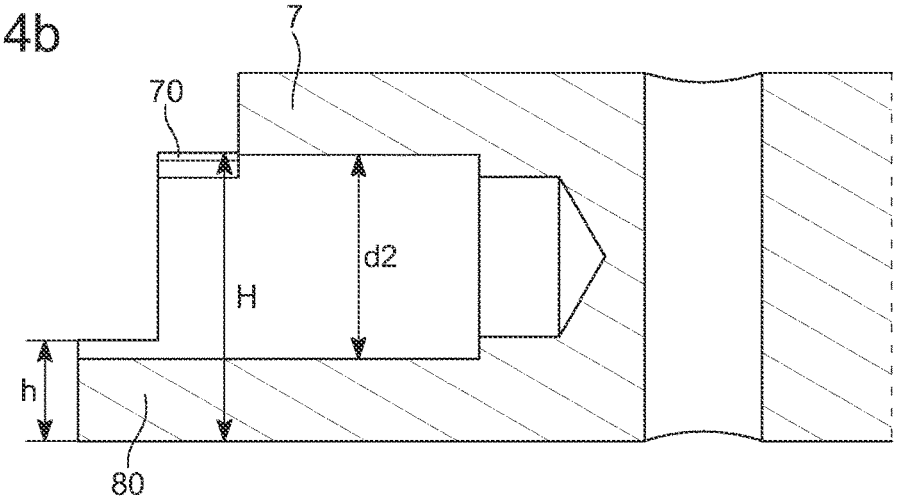
Figure 4C:
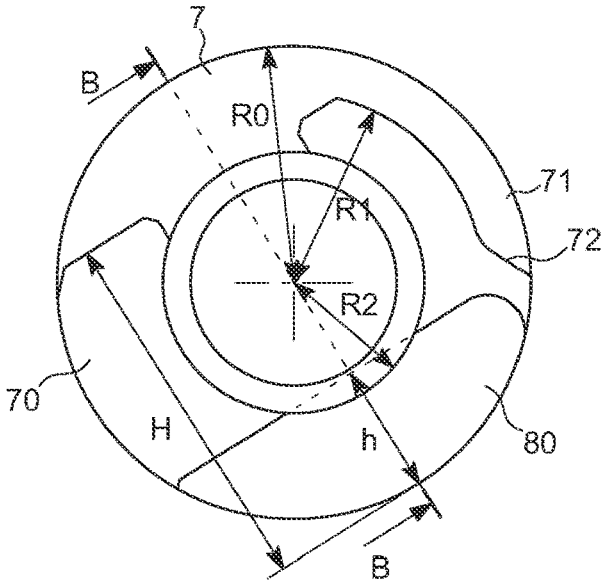

As can be observed in FIGS. 4*a* and 4*b*, the first cylindrical shouldered portion 70 and the second cylindrical shouldered portion 80 are formed one after the other and have different dimensions so as to form bearings with different heights. The first cylindrical shouldered portion 70 has a height H which is larger than the radius r of rod 7, and the second shoulder has a height h which is smaller than the radius r of rod 7.

The first cylindrical shouldered portion 70 allows forming a clearance for the ball 82 of the ball-pawl 8, the body 81 of the ball-pawl 8 being flush with the first cylindrical shouldered portion 70 and the ball 82 projecting from the plane formed by the surfaces of the body 81 and the first cylindrical shouldered portion 70.

The second cylindrical shouldered portion 80 is arranged to cooperate with the groove 51, the second cylindrical shouldered portion 80 being inserted into the groove 51 via an outwardly directed opening 60 giving access to the groove 51 and the ramp 52, the height h of the second cylindrical shouldered portion 80 having similar dimensions to those of the rectilinear portion 51' of the groove 51 so that the second cylindrical shouldered portion 80 slides in the rectilinear portion 51'.

As can be observed in FIG. 5, groove 51 comprises a first stop element 54 which is arranged to cooperate with a flat 90 on the second shouldered portion 80 so as to limit the rotational travel of the rod 7.

The female connecting elements comprise a second stop element 55 to limit rotation of the rod 7. This second stop element 55 is formed setback and in height with respect to the first stop element 54. The second stop element 55 is arranged to cooperate with the first shouldered portion 70 which locally has a notch 71 at its periphery, the length of the notch 71 defining the length of the angular travel of the rod 7. The notch 71 has at its end a contact surface 72 arranged to cooperate with second stop element 55.

Such an arrangement with two stop elements 54, 55 allows for greater strength and enhanced safety, since the parts and the surfaces in contact have small sizes.

Figure 3:
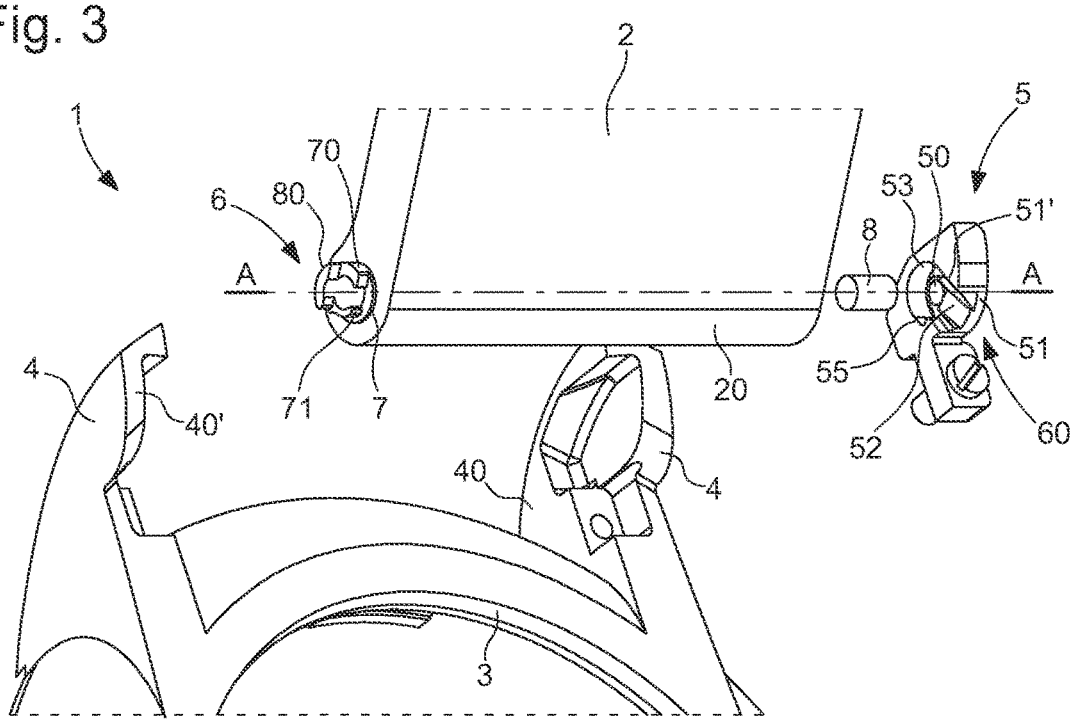
FIG. 3 shows an exploded view of a fastening device according to the invention.

According to an embodiment of the invention, each female connecting element 5 is an element attached to the inner areas 40, 40' of the two pairs of horns. As illustrated in FIG. 3, each female connecting element 5 is screwed onto an inner area 40, 40' of a horn.

According to another embodiment, not illustrated in the figures, each female connecting element 5 is machined directly on the inner areas 40, 40' of the two pairs of horns.

Each female connecting element 5 is made of a metal material, of a metal alloy, of a plastic material or of a ceramic material. In the case where the female connecting element 5 is attached to the horn 4, it is possible to consider combining the materials and have a horn made of metal or of a metal alloy and a female connecting element 5 made of ceramic or of a plastic material, for example.

To fasten the bracelet 2 to the case 1, the first and second shouldered portions 70, 80 are inserted as illustrated in FIG. 4*a*, corresponding to the ends of the rod 7 secured to the bracelet, by presenting them opposite the openings 60 of the female connecting elements 5.

Once the first and second shouldered portions have been inserted into the opening, the wearer slips the pin 7 (or the bracelet) to the back of the rectilinear portion 51' of the groove 51, the groove 51 guiding the second shouldered portion 80. A "click" enables positioning of the pin 7 with respect to its axis of rotation thanks to the engagement of the ball-pawl 8 in the blind housing 50. This also serves as a reference point for the wearer, the engagement of the ball-pawl 8 in the blind housing 50 meaning that the wearer can now make the bracelet 2, and therefore the pin 7, pivot into the wearing position, which allows avoiding the rod 7 becoming dislodged from the female connecting elements 5.

Figure 6A:
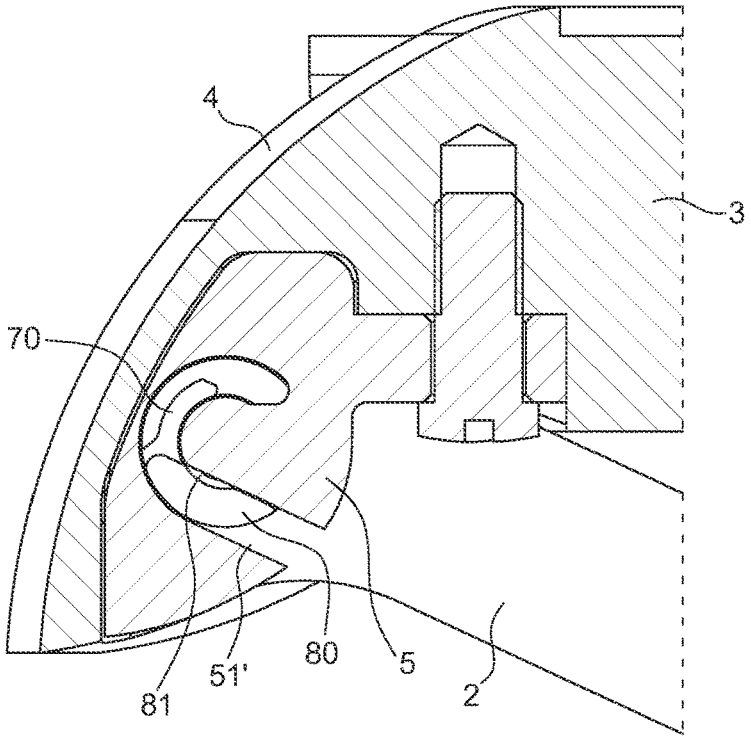
FIGS. 6*a* and 6*b* show, respectively, sectional views of a fastening device according to the invention in the inserted position and in the locked position.
Figure 6B:
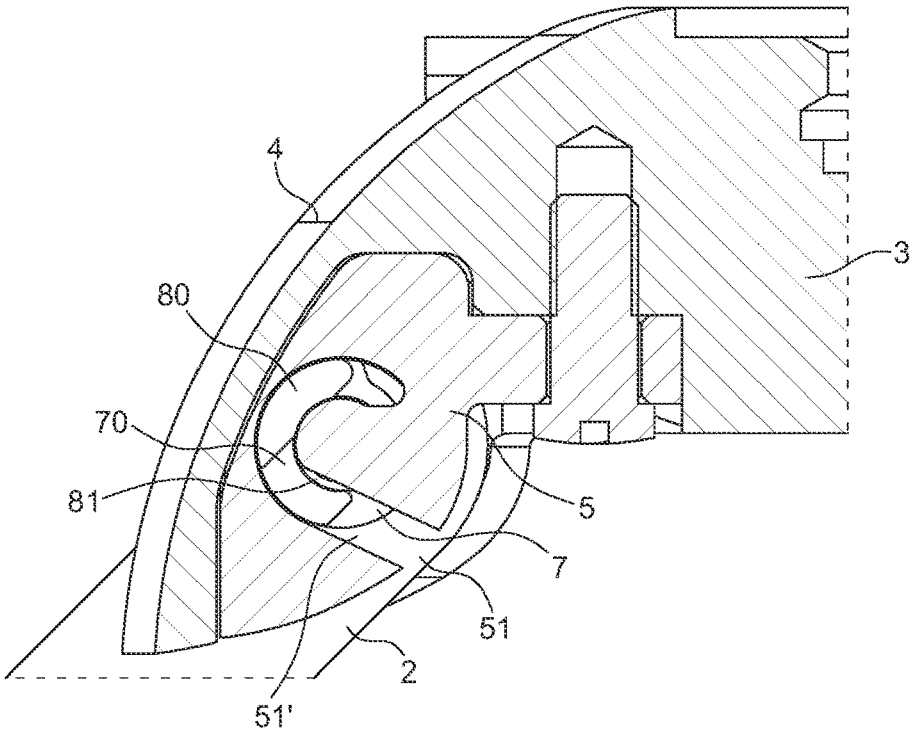

Once the ball-pawl 8 is engaged in the blind housing 50, the user makes the rod 7 pivot about the axis A-A through the bracelet until the bar performs a rotation at least 90° about the axis A-A from its insertion position, or until the first and second shouldered portions 70, 80 come into contact with the first and second stop elements 54, 55, so that the bracelet can no longer be dislodged, as can be observed in FIG. 6*b*.

To remove the bracelet, simply perform the reverse operations and exert a slight force on the bracelet to disengage the ball-pawls 8 from the blind housings 50.

In the previously-described embodiment, the device is described 5 for a so-called flexible bracelet made of leather, synthetic fabric or elastomer material. The device can also be adapted to a bracelet made of metal or ceramic links, for example.

Thanks to these different aspects of the invention, a secure bracelet fastening device is made available enabling bracelets to be changed easily and quickly without the need for tools.

Of course, the present invention is not limited to the illustrated example and various alternatives and modifications that may be apparent to a person skilled in the art can be made thereto.

The invention claimed is:

1. A device for fastening a bracelet to a watch case along an articulation axis, at two pairs of horns, by means of at least one female connecting element secured to the case of the watch and at least one male element secured to one end of the bracelet, these elements being complementary so as to cooperate by fitting one into the other, while forming removable assembly means capable of making the bracelet interchangeable, wherein each of the male elements includes a rod connected to a corresponding end of the bracelet and extending along the articulation axis, and extending on either side of the rod, a ball-pawl and first and second cylindrical shouldered portions arranged concentrically around each ball-pawl, each ball-pawl and each cylindrical shouldered portion being arranged to cooperate respectively with a blind housing and a groove proximate to the blind housing, and forming the female connecting elements on inner areas of the two pairs of horns.

2. The fastening device according to claim 1, wherein each female connecting element comprises a ramp disposed upstream of the blind housing, the ramp being arranged to cooperate with the ball-pawl, the blind housing being at the end of the ramp.

3. The fastening device according to claim 1, wherein the groove successively comprises a rectilinear portion and an arcuate portion.

4. The fastening device according to claim 1, wherein the groove comprises a first stop element for limiting the rotation of the rod.

5. The fastening device according to claim 1, wherein the first shouldered portion has a height (H) larger than the radius (r) of the rod, and the second shouldered portion has a height (h) smaller than the radius (r) of the rod.

6. The fastening device according to claim 4, wherein the first shouldered portion locally has a notch at its periphery, the notch corresponding to a length of an angular travel of the rod and being arranged to cooperate with a second stop element.

7. The fastening device according to claim 6, wherein the second stop element is superimposed on the first stop element and offset relative to the first stop element.

8. The fastening device according to claim 1, wherein each female connecting element is an element attached to the inner areas of the two pairs of horns.

9. The fastening device according to claim 1, wherein each female connecting element is made of a metal material or metal alloy.

10. The fastening device according to claim 1, wherein the end of the bracelet comprises a passage arranged to receive the rod.

11. The fastening device according to claim 1, wherein the bracelet is secured to the rod.

12. The fastening device according to claim 1, wherein the rod is rotatable about the articulation axis from a insertion position at which the bracelet can be fastened to the watch case and a locked position at which said bracelet is locked to said watch case.

* * * * *